US005519595A

United States Patent [19]

Wang

[11] Patent Number: 5,519,595

[45] Date of Patent: May 21, 1996

[54] FORMATIVE FLAG

[75] Inventor: Jaw-Pang Wang, Taipei, Taiwan

[73] Assignee: Chi Chen Co., Ltd., Taipei, Taiwan

[21] Appl. No.: 321,270

[22] Filed: Oct. 11, 1994

[51] Int. Cl.[6] ..... F21V 33/00

[52] U.S. Cl. ..... 362/234; 362/252; 362/253; 362/431; 362/808; 40/218

[58] Field of Search ..... 40/218, 541; 362/103, 362/234, 249, 252, 253, 806–808, 812, 431

[56] References Cited

U.S. PATENT DOCUMENTS

| | | | |
|---|---|---|---|
| 1,258,022 | 3/1918 | Kray | 362/806 |
| 1,383,234 | 6/1921 | Raguse | 362/812 |
| 1,878,447 | 9/1932 | Sutphen | 362/806 |
| 4,110,818 | 8/1978 | Hempsey | 362/252 |
| 4,164,008 | 8/1979 | Miller et al. | 362/252 |
| 5,280,270 | 1/1994 | Correa et al. | 40/541 |
| 5,371,657 | 12/1994 | Wiscombe | 362/103 |

*Primary Examiner*—Denise L. Gromada
*Assistant Examiner*—Alan B. Cariaso
*Attorney, Agent, or Firm*—Browdy and Neimark

[57] ABSTRACT

An improved formative flag has a flag embodiment having holes at proper positions for disposing fastening seats thereon so as to secure a plurality of light bulbs thereto. A flag pole is made up of two sections which are coupled by a connecting tube. A battery box is housed in a receiving bag at the one side of the flag embodiment. The battery box having one end connected to the light bulbs for supply of power thereto. The flag embodiment can be decorated with any kinds of artistic drawings so as to make the flag appealing to the eyes of people.

9 Claims, 4 Drawing Sheets

FORMATIVE FLAG

BACKGROUND OF THE INVENTION

There are many kinds of formative flags sold in the markets differing from one another merely in artistic drawings and colors on flag embodiments or the shapes thereof. The difference one can make is limited only to a plane, but an improved formative flag of the present invention has been invented to give formative flags new lives.

SUMMARY OF THE INVENTION

It is a primary object of the present invention to provide a flag having fastening seats to support a plurality of light bulbs of different colors and shapes connected to a battery box in which batteries are housed so as to attract people's attention after the lights are switched on.

BRIEF DESCRIPTION OF THE DRAWINGS

FIG. 1—1 is an enlarged diagram showing an elastic securing ring disengaged with a fastening seat.

FIG. 2–1 is an enlarged diagram showing a fastening seat of the present invention;

FIG. 3–1 is an enlarged diagram showing a light bulb mounted to a fastening seat;

DETAILED DESCRIPTION OF THE PREFERRED EMBODIMENTS

Figure 1:
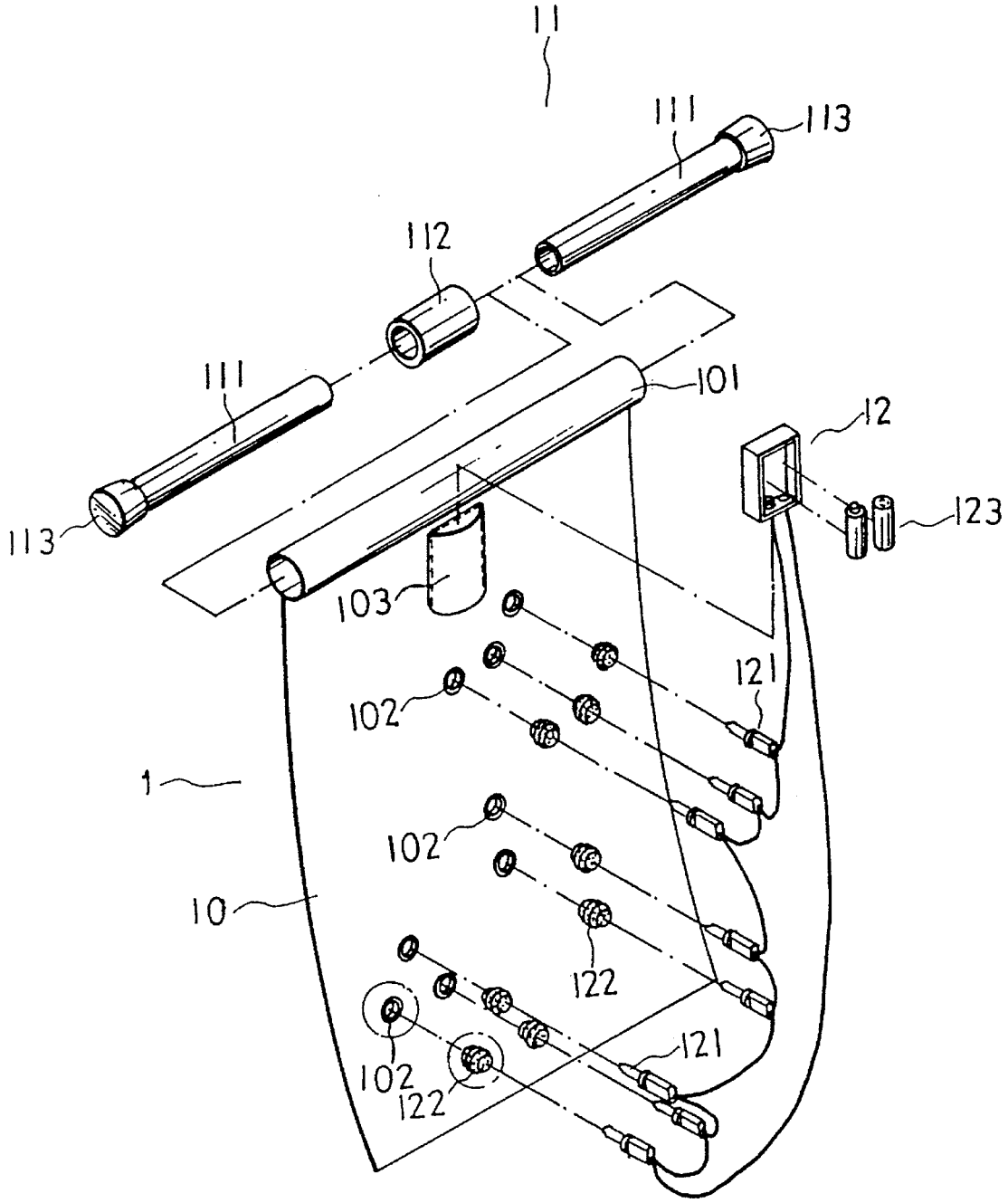
FIG. 1 is a diagram showing the disassembled components of the present invention.
Figure 1:
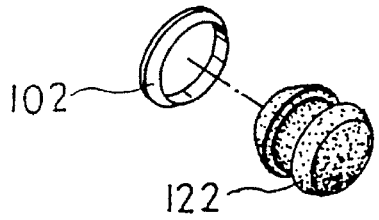

Referring to FIG. 1, an improved formative flag 1 having a flag embodiment 10, a flag pole 11 and a battery box 12. The flag embodiment 10 has one side sewed into a tubular hole with a sewing line 101 for permitting the flag pole 11 to pass therethrough. The flag embodiment 10 has a plurality of holes disposed at proper positions for securing the fastening seats 102 thereto. The flag embodiment 10 has a receiving bag 103 for storage of the battery box 12 at the back. The flag embodiment 11 is made up of two straight tubes 111 of smaller caliber coupled to each other by a connecting tube 112 of larger caliber. The outer ends of the straight tubes 111 are caped with a lid 113 respectively.

The battery box 12 has one end connected to a string of decorative light bulbs 121 serially connected to one another. Elastic securing rings 122 are flexibly engaged with fastening seats 102 secured to the flag embodiment 10.

Figure 2:
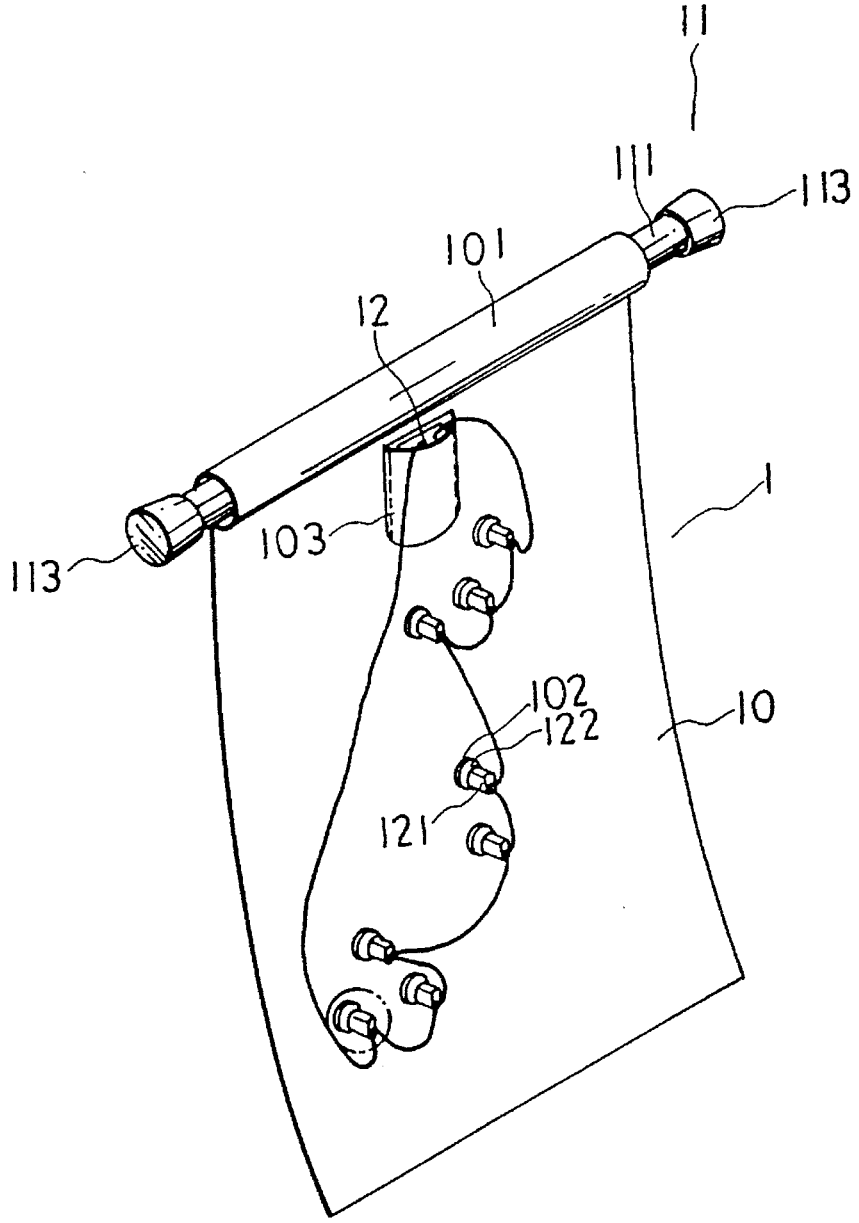
FIG. 2 is a diagram showing the assembled mode of the present invention.
Figures 1, 2:
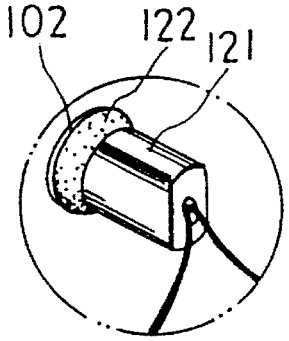

Referring to FIG. 2, when assembling the flag of the present invention the battery box must be put into the receiving bag 103 first, and then the decorative light bulbs 121 are secured by elastic rings 122 to the fastening seats 102 on the flag embodiment 10. After all the decorative light bulbs 121 are fixed in place, then the combined flag pole 11 is led through the tubular hole 101. Finally the batteries 123 are placed into the battery box 12 so as to supply electrical power to the light bulbs.

Figure 3:
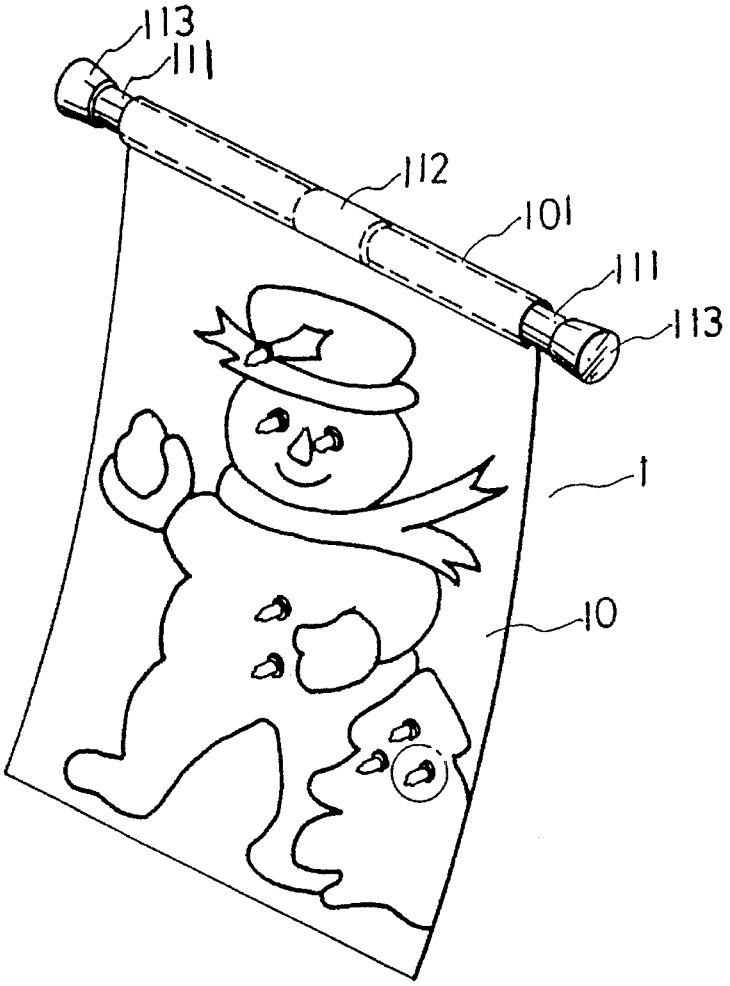
FIG. 3 is a diagram showing a practical embodiment thereof.
Figures 1, 3:
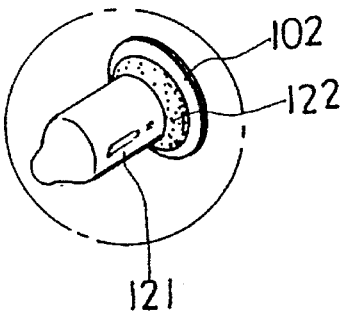
Figure 4:
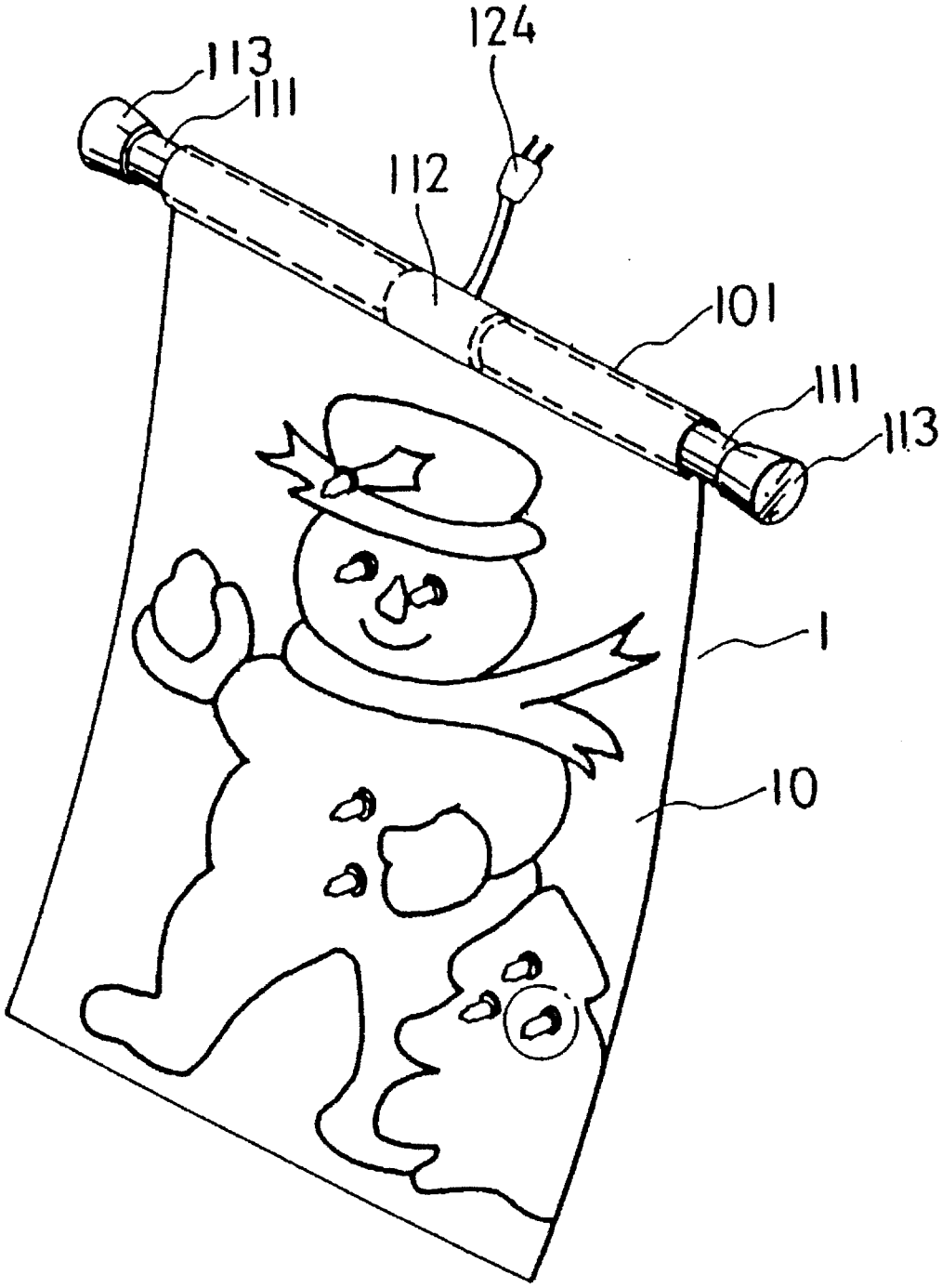
FIG. 4 is another embodiment of the invention.

Referring to FIG. 3, an embodiment of the present invention is illustrated with an artistic design put on the formative flag 1. In FIG. 4, another embodiment of the present invention is shown wherein alternating current is supplied to the light bulbs 121 via a wired plug 124 which can be plugged in a receptacle in use so that the flag of the present invention can be powered both by AC or DC.

I claim:

1. An improved formative flag comprising:

a flag embodiment having a tubular hole at one side thereof for permitting a flag pole to pass therethrough;

a flag pole; and a power supply means;

a plurality of bulb securing means engaged with said flag embodiment; disposed over said flag embodiment;

a plurality of bulbs removably fixed onto said bulb securing means being electrically coupled to one another and powered by said power means,

2. An improved formative flag as claimed in claim 1 wherein said flag embodiment has a plurality of fastening seats disposed at proper positions thereon for support the light bulbs in place; and at the back of said flag embodiment is disposed a receiving bag for storage a battery box in which batteries are housed.

3. An improved formative flag as claimed in claim 1 wherein said flag pole has two straight tubes of smaller caliber which are coupled together by a connecting tube of larger caliber.

4. An improved formative flag as claimed in claim 1 wherein said power supply means has a plug means which is coupled to an alternating current source.

5. A formative flag for use with lamp bulbs connected by wires, each of the bulbs having a generally tubular portion; the flag comprising:

a support rod;

a flexible flag body;

a tubular hole at one side of the flag body for permitting the support rod to pass therethrough; and a plurality of bulb holders, each of said bulb holders including an elastic ring for holding the tubular portion of the bulb and a fastening seat attached to the flag body for securing the elastic ring to the flag body;

whereby the bulbs may be removably disposed within the holders in a selected pattern.

6. The flag according to claim 5, wherein the rod includes two lid caps disposed at either end of the rod.

7. The flag according to claim 5, wherein the bulbs are connected by the wires in a serial connection.

8. The flag according to claim 7, wherein the bulbs are powered by AC line current.

9. The flag according to claim 5, wherein the bulbs are powered by a battery pack and the flag body includes a battery pack pocket.

* * * * *